United States Patent [19]

Kemmner

[11] 4,407,642

[45] Oct. 4, 1983

[54] FUEL SUPPLY UNIT

[75] Inventor: Ulrich Kemmner, Stuttgart, Fed. Rep. of Germany

[73] Assignee: Robert Bosch GmbH, Stuttgart, Fed. Rep. of Germany

[21] Appl. No.: 228,043

[22] Filed: Jan. 26, 1981

[30] Foreign Application Priority Data

Feb. 2, 1980 [DE] Fed. Rep. of Germany ..... 3003828

[51] Int. Cl.[3] ..... F04B 17/00; B67D 3/00

[52] U.S. Cl. ..... 417/366; 222/67; 137/399

[58] Field of Search ..... 417/366, 211.5, 297.5, 417/442; 418/159; 137/399; 222/67, 65, 377, 382; 415/24

[56] References Cited

U.S. PATENT DOCUMENTS 2,290,461 7/1942 Young ..... 137/399
4,231,719 11/1982 Ringwald et al. .

FOREIGN PATENT DOCUMENTS 53-13103 2/1977 Japan ..... 417/442
1024787 4/1966 United Kingdom .
1186577 4/1970 United Kingdom .

*Primary Examiner*—Richard E. Gluck
*Assistant Examiner*—Peter M. Cuomo
*Attorney, Agent, or Firm*—Edwin E. Greigg

[57] ABSTRACT

A fuel supply unit is proposed, in particular an assembly comprising a pumping element and an electromotor to drive it housed together in a common housing, which is secured in an upright position in the interior of a fuel container in such a manner that the pumping element is disposed near the bottom of the fuel container to enable aspiration of fuel from the fuel container until it is as nearly empty as possible. The pumping element has a first intake area oriented toward the bottom of the fuel container and a second intake area remote from the bottom of the fuel container, the second intake area being closable by a closure member movably disposed on the fuel supply unit whenever the fuel level in the fuel container drops below a predetermined level, so that fuel is then aspirated only via the first intake area. The closure member is actuatable by means of a floater body.

2 Claims, 5 Drawing Figures

PRIOR ART

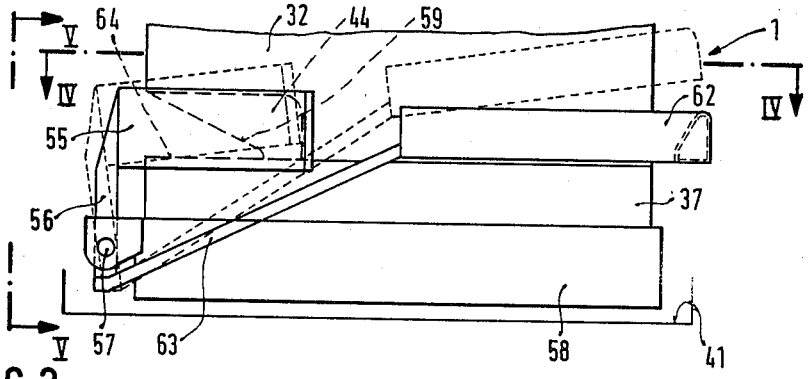
FIG.3
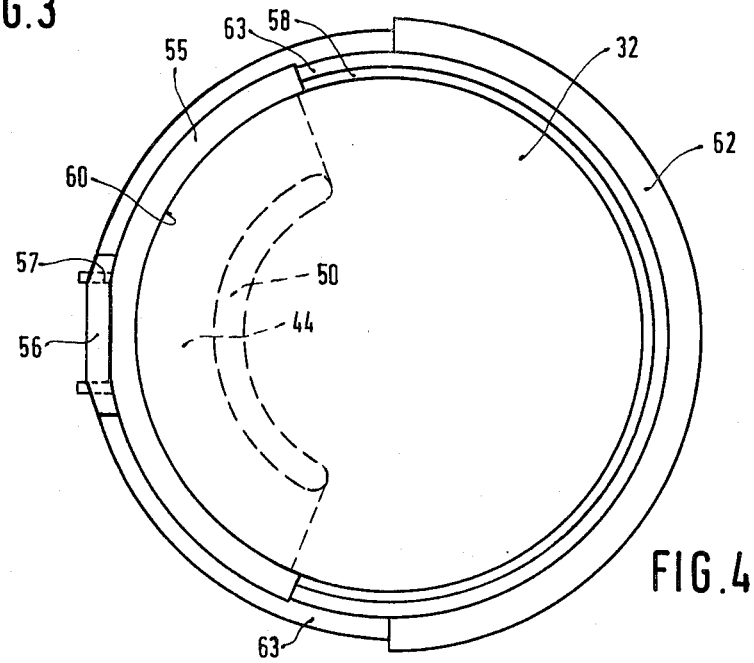
FIG.4
FIG.5
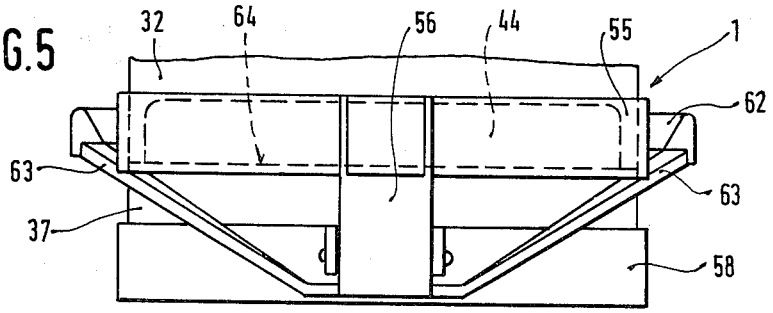

FUEL SUPPLY UNIT

BACKGROUND OF THE INVENTION

The invention relates to a fuel supply unit comprising a pumping element and an electromotor arranged to drive the same. The pumping element and electromotor are housed in a common housing. A fuel supply unit is already known which is secured upright within a fuel container in such a manner that the pumping element is disposed near the bottom of the fuel container, a first intake area being provided oriented toward the bottom of the fuel container and a second intake area being provided which is remote from the bottom of the fuel container. As a result of this arrangement, it is possible to carry any vapor bubbles arising at elevated fuel temperatures away from the pump chamber and thus to assure satisfactory fuel supply. However, this arrangement also has the disadvantage that when the fuel level in the fuel container drops below the level of the second intake area, no further fuel is supplied. This stops the engine or prevents it from turning over upon starting, even though, since such containers at the present time are generally quite flat in shape, the container may still contain a relatively large quantity of fuel.

OBJECT AND SUMMARY OF THE INVENTION

The fuel supply unit according to the invention has the advantage over the prior art that an intervention is made by simple means into the fuel supply unit whenever the fuel level drops below the second intake area, so that a further supply of fuel is possible until the fuel container is almost entirely empty.

The invention will be better understood and further objects and advantages thereof will become more apparent from the ensuing detailed description of preferred embodiments taken in conjunction with the drawings.

BRIEF DESCRIPTION OF THE DRAWINGS

FIG. 3 is a partial side elevational view of the bottom end of the fuel supply unit housing showing an apparatus according to the invention for closing an second intake area;

FIG. 4 is a section taken along the line IV—IV of FIG. 3; and

FIG. 5 is a section taken along the line V—V of FIG. 3.

DESCRIPTION OF THE PREFERRED EMBODIMENT

Figure 1:
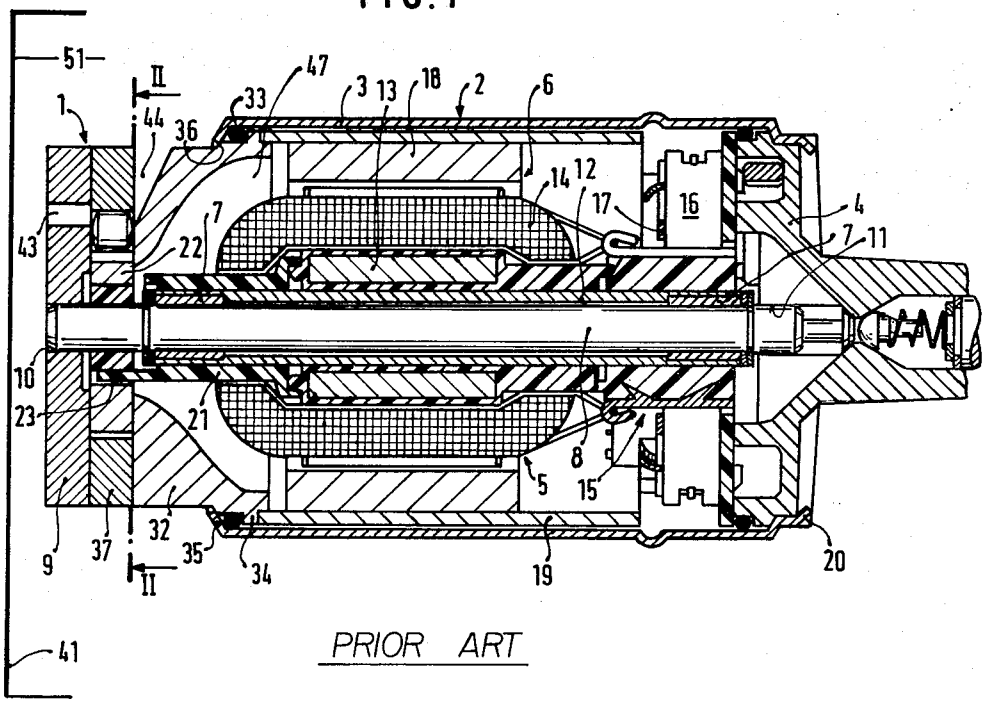
FIG. 1 PRIOR ART
FIG. 1 is a longitudinal cross-sectional view taken through a known fuel supply unit.
Figure 2:
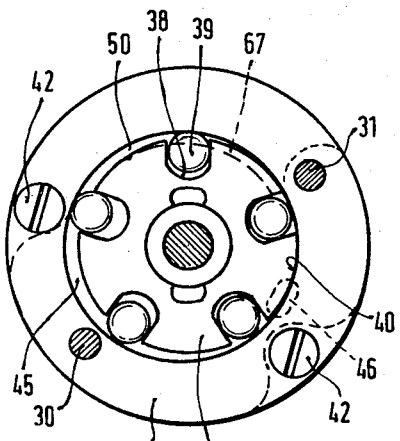
FIG. 2 PRIOR ART
FIG. 2 is a section taken along the line II—II of FIG. 1.

For the sake of better understanding the present invention and in order to place the invention in the technical field appropriate to it, the fundamental principal of a fuel supply unit will first be explained briefly, with the aid of FIGS. 1 and 2, in terms of its structure and operation. This fuel supply unit is one whose pumping element is embodied in one stage, although the invention is applicable to any arbitrary pump type, including fuel supply pumps having several pumping stages.

The pumping stage used in the exemplary embodiment is a so-called roller cell pump 1, whose structure and specialized embodiment will be discussed again further below. Adjoining the compression side of the roller cell pump 1 is the electromotor 2 which drives it, the electromotor 2 being disposed in a tubular housing 3, which is sealed on the compression side by a cap 4.

The fuel supplied by the pump 1 under pressure flows through the electromotor 2 and its components, so that the electromotor 2 accordingly undergoes cooling.

The electromotor 2 comprises a rotating armature or motor rotor 5 and a magnetic element 6. The rotor 5 is supported via suitable bearings, for instance bearing bushes 7, on a stationary shaft 8, which by way of example is firmly pressed into stationary, bearing elements in the forward and the rear areas of the fuel supply unit. In the fuel supply unit shown, there is a base body 9 in the pumping area which has a central bore 10 into which the shaft 8 is pressed. The other end of the shaft 8 is pressed into a suitable bore 11 of the cap 4. The bearing bushes 7 supporting the rotor 5 on the shaft 8 are disposed in a carrier tube 12, on which a laminar packet 13 and an armature winding packet 14 are located. A collector bushing 15 is also secured on the carrier tube 12, for instance by being pressed onto this element.

Carbon brushes 16 which are disposed in cages 17 slide on the collector bushing 15. The cages 17 are connected in an electrically conductive manner with connection terminals which are disposed in the cap 4 but not shown in FIG. 1. The magnetic element 6 of the electromotor 2 comprises two permanent magnets 18 disposed in a tubular or cylindrical holder element 19, which for example may be an element suitably shaped from sheet metal and made of some magnetically conductive material. This holder element 19 simultaneously serves to hold securely at least one stationary component in the pumping area 1, because a corresponding tensioning pressure is exerted on the holder element 19 from the direction of the cap 4, by way of intermediate and structural components not shown in detail. The cap 4 itself is secured on the open end, on the compression side, of the outer housing tube 3 by means of a flange 20.

A fluid pump is driven by the electromotor 2 with the aid of a coupler 21 connected with the rotor 5. The fluid pump may in principle be any arbitrary type, for instance a gear pump, a lateral-channel pump, a roller cell pump, or some other pump requiring ventilation. In the illustrated exemplary embodiment, it is embodied as a roller cell pump 1, so that the rotary coupling of the rotor 5 via the coupler 21 is exerted upon a grooved disc 22 of the roller cell pump; in fact, this is effected by the engagement of an appropriate groove 23 in the grooved disc 22 by the coupler 21.

The base body 9 is disposed so that it is free toward the outside, and it is connected by at least two screws 30 and 31 (see FIG. 2) with a support body 32. The support body 32 is seated, with a seal 33 which seals off the intake side from the compression side being interposed, in the tubular pump housing 3 by means of a radial annular flange 34; this annular flange 34 and a flange 35 of the housing tube 35 receive between them the O-ring which acts as the seal 33. The support body 32 is thus held securely so that it cannot be dislodged, as a result of the contact of a conical annular face 36 against the flange 35 of the housing 3 and as a result of the pressure exerted upon it by the holder elememt 19.

The base body 9 and the support body 32, between them, recieve the grooved disc 22 and an intermediate disc 37.

The remaining structure of the roller cell pump 1 is such that grooves 38 are disposed in the grooved disc 22 in which rollers 39, acting as pumping bodies, are disposed so as to be radially displaceable. The rollers 39 are guided on their circular jacket face by lateral faces, extending parallel to one another, of the associated groove 38; they are also guided on either side by the base body 9 on one side and by the support body 32 on the outer. Because of the centrifugal forces created by the rotation of the grooved disc 22, the rollers 39 are pressed against a path 40 which is formed by an eccentric bore in the intermediate disc 37. The intermediate disc 37 is threadedly secured with its eccentric bore to the base body 9 by means of at least two screws 42, as a result of which the radial gap between the grooved disc 22 and the intermediate disc 37 may be set precisely. The screws 30, 31 are guided through the intermediate disc 37 with play.

The fuel supply unit is secured in a fuel container, preferably in an upright position, with the roller cell pump 1 disposed near the bottom 41 of the fuel container.

An essential characteristic of the present fuel supply unit is that the entire intake area of the roller cell pump is open. Thus a first intake area 43 is formed on the side of the base body 9 oriented toward the bottom 41 of the fuel container, and a second intake area 44 is formed on the side remote from the bottom 41 of the fuel container, between the intermediate disc 37 and the support body 32. As a result of the eccentric disposition of the intermediate disc 37 relative to the shaft 8 or to the grooved disc 22 disposed on this shaft, a crescent-shaped pump work chamber 45 is created, in consequence of the eccentric positioning of the pumping components, which is traversed by the rollers 39. This pump work chamber 45 becomes smaller during the course of operation with respect to a particular roller 39, so that the fuel located in the pump work chamber 45 is placed under pressure. The fuel then escapes from the pumping area via a pressure opening 46 in the support body 32 and reaches the chamber 47 of the fuel supply unit which contains the electromotor 2. The fuel located in the first intake area 43 or the second intake area 44 reaches the pump work chamber 45 via an intake opening 50, which is kidney-shaped by way of example; so long as the cresent shape of this pump work chamber 45 is still increasing in size with respect to a particular roller 39 during the course of operation, this intake opening 50 overlaps a broad portion of the pump work chamber 45.

Because the fundamental structure of such roller cell pumps is known, no further discussion thereof or of the functioning of such a pump is needed here.

However, it is known and disadvantageous that during the intake process vapor bubbles can form, as the result of the fuel temperature in combination with the pressure drop which occurs; these vapor bubbles must then be carried out of the intake area of the pump 1 so as to assure satisfactory fuel supply. In the present fuel supply unit shown here, these gases and vapors are carried out of the intake area, or out of the pumping area in general, by the recessing of the support body 32 in the region of the intake opening 50, forming a second intake area 44. In other words, the roller 39 and grooved disc 22 are only partially overlapped toward the top and bottom; that is, the pumping chamber formed at a particular time is open in the intake area.

It will be understood that the chamber 51 surrounding the intake areas 43, 44 must contain fuel, from which the pump 1 aspirates the fuel quantity which is to be supplied.

As a result of the second intake area 44 which is open toward the top, it is easily possible for any vapor bubbles which may form to flow out into the chamber 51 surrounding the pump, even when such bubbles may form in the pumping chambers (that is, between the grooved disc, rollers and intermediate disc), for as long as the pumping chamber still communicates freely with the second intake area 44 and has not made the transition to an area closed on all sides for the sake of building up pressure.

The pumping element 1 of the fuel supply unit is advantageously secured in the filter basket of a known spin chamber inside the fuel container. Now if the fuel level in the fuel container drops to such an extent that the second intake area 44, or the intake opening 50 leading from it to the pump work chamber 45, is no longer covered with fuel, then the fuel supply is interrupted, although in the case of present-day fuel containers, which are quite flat, there is still a relatively large quantity of fuel in the container. In order to prevent a failure of fuel supply such as this, the invention provides that if the fuel level in the fuel container drops below a predetermined level, that is, below the second intake area 44, then the second intake area 44 is closed off by means of a closure member 55 movably disposed on the fuel supply unit; thus fuel can continue to be aspirated via the first intake area 43 and supplied by the roller cell pump 1 until the level of the fuel has dropped below the level of the first intake area 43. To this end, as shown in FIGS. 3, 4 and 5, the closure member 55 is secured on a lever 56 and pivotably supported about a point of rotation 57 provided on a holder sleeve 58, which is pressed against the base body 9 or the intermediate disc 37 of the roller cell pump 1 and is secured against twisting or being dislodged. The closure member 55 has an annular-circular cross section and it engagingly surrounds the second intake area 44 formed between the cylindrical support body 32 and the cylindrical intermediate disc 37 to such an extent that the second intake area 44, upon a pivotal movement of the closure member 55 toward the second intake area 44, is entirely closed by the closure member 55. In FIGS. 3, 4 and 5, the closure member is illustrated in the closing position in which it completely overlaps the second intake area 44 and prevents the aspiration of fuel. The second intake area 44 is produced because the support body 32 is recessed obliquely along the intake edge 59, which is indicated by broken lines, to such an extent that there is at least partial overlapping by the intake opening 50. The closure member 55 may be provided with a sealer coating on its face 60 oriented toward the intake area 44, this coating being of rubber or synthetic by way of example.

The closure member 55 is actuatable by means of a floater body 62, whose position is determined by the level of the fuel in the fuel container. To this end, the floater body 62 is embodied as a hollow, annular body which partially surrounds the roller cell pump 1 on the side remote from the second intake area 44 and is connected with a lever 63, which is connected in turn on its other end, pivotably supported about the point of rotation 57, with the lever 56 of the closure member 55. The levers 56 and 63 thus together embody a two-armed lever pivotable about the point of rotation 57 attached to the housing. If the level of fuel in the fuel container is above the second intake area 44, then the floater body 62 assumes a position such as is indicated by broken lines, as a result of which the closure member 55 is moved into its position also indicated by broken lines, and fuel can be aspirated by the roller cell pump 1 via the second intake area 44. The floater body 62 and the closure member 55 are intended to be coupled together via the levers 56, 63 in such a way that when the fuel level in the fuel container drops to the level indicated by a lower edge 64 of the second intake area 44, the closure member 55 assumes its closing position which closes the second intake area 44. The blocking and sealing action of the closure member 55 is attained on the one hand as the result of the force of gravity engaging the floater body 62 and the lever 63 and on the other hand as the result of the suction action in the second intake area 44. When the second intake area 44 is closed, fuel can be further aspirated via the first intake area 43 until the level is only a few millimeters above the bottom of the fuel container. The closure member 55, floater body 62 and lever 56, 63 may advantageously be manufactured of synthetic material.

This application discloses further improvements in fuel supply units of the type disclosed in pending applications to Ringwald et al Ser. No. 916,415 filed June 16, 1978, now U.S. Pat. No. 4,231,719 issued Nov. 14, 1980, Ringwald Ser. No. 146,865 filed May 5, 1980 and Mutschele application Ser. No. 146,869 also filed May 5, 1980. These cases are assigned to the assignee of the present invention.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel supply unit, comprising a pumping element and an electromotor arranged to drive the same, said pumping element and electromotor being housed together in a common housing having a cylindrical body portion at one end thereof, said housing being secured in an upright position in the interior of a fuel container in such a manner that the pumping element cylindrical body portion is located near the bottom of said fuel container, said pumping element having a first intake area oriented toward the bottom of the fuel container and a second intake area remote from the bottom of said fuel container, and a closure member externally movably disposed on said fuel supply unit for movement transversely of the cylindrical body portion to close said second intake area from the outer side of said pumping element, said closure member being actuatable by means of a floater body, the position of said floater body being determined by the level of the fuel within said fuel container, said closure member and said floater body being interconnected via a lever means externally pivotably supported on a holder sleeve placed over said cylindrical body portion, said closure member having a semi-circular cross section arranged to partially surround said cylindrical body portion on said housing in proximity to said intake areas, said floater body being embodied as a hollow, semi-annular body which partially surrounds said fuel supply unit on a side remote from said second intake area.

2. A fuel supply unit according to claim 1 in which said second intake area is embodied by a recess in said pumping element cylindrical body portion.

* * * * *